US006202946B1

(12) United States Patent
Virtanen

(10) Patent No.: US 6,202,946 B1
(45) Date of Patent: Mar. 20, 2001

(54) METHOD AND APPARATUS OF DEFIBRATING A FIBRE-CONTAINING MATERIAL

(75) Inventor: Hannu Virtanen, Tampere (FI)

(73) Assignee: Megatrex Oy, Tampere (FI)

( * ) Notice: Subject to any disclaimer, the term of this patent is extended or adjusted under 35 U.S.C. 154(b) by 0 days.

(21) Appl. No.: 09/331,772

(22) PCT Filed: Dec. 4, 1997

(86) PCT No.: PCT/FI97/00755

§ 371 Date: Jun. 24, 1999

§ 102(e) Date: Jun. 24, 1999

(87) PCT Pub. No.: WO98/29596

PCT Pub. Date: Jul. 9, 1998

(30) Foreign Application Priority Data

Jan. 3, 1997 (FI) ..... 970049
Feb. 12, 1997 (FI) ..... 970591

(51) Int. Cl.[7] ..... B02C 19/12
(52) U.S. Cl. ..... 241/21; 241/23; 241/28
(58) Field of Search ..... 241/16, 21, 28, 241/80, 97, 23

(56) References Cited

U.S. PATENT DOCUMENTS 4,431,482 2/1984 Heinbockel et al. .
5,904,308 * 5/1999 Schnell ..... 241/188.2

FOREIGN PATENT DOCUMENTS 372537 11/1963 (CH) .
19541892 11/1996 (DE) .
98052 12/1996 (FI) .
1271863 4/1972 (GB) .

* cited by examiner

*Primary Examiner*—Mark Rosenbaum
(74) *Attorney, Agent, or Firm*—James C. Lydon

(57) ABSTRACT

A method and device for defibrating fiber-containing material in a device operating with the pin mill principle. The device includes a housing and in it a first rotor equipped with collision surfaces; a second rotor concentric with the first rotor and equipped with collision surfaces, the second rotor being arranged to rotate in a direction opposite to the first rotor; or a stator concentric with the first rotor and equipped with collision surfaces. Further, the device includes a feed orifice in the housing and opening to the center of the rotors or the rotor and stator, and a discharge orifice on the housing wall and opening to the periphery of the outermost rotor or stator. The fiber-containing material is led from the feed orifice to the housing and made to flow together with air or liquid generating a suspension through the collision surfaces of the nested rotors, or the nested rotor and stator to the discharge orifice and further as a discharge flow out of the housing.

11 Claims, 5 Drawing Sheets

FIBRE LENGTH DISTRIBUTION

METHOD AND APPARATUS OF DEFIBRATING A FIBRE-CONTAINING MATERIAL

The present invention relates to a method and device for defibrating a fibre-containing material, as disclosed in the introduction of the appended independent claims. The invention also relates to the use of a multi-peripheral pin mill for defibrating fibre-containing material.

The concept "fibre-containing material" is later to be understood as a wide concept comprising wood chips, grass and other fibre-containing materials originating from the vegetable kingdom, which have been crushed to pieces of appropriate sizes so that they can be fed into the pin mill. The concept also includes inorganic fibres, such as mineral and glass wood fibres.

The concept "defibration" covers the separation of fibres from each other, wood or other raw materials in the vegetable kingdom, or other components. In this text, the concept also covers the fibrillation of separate fibres.

In principle, mechanical pulp is manufactured in two ways, i.e. by grinding logs of wood to ground pulp against pulp-stone, or by defiberizing wood chips in a disc refiner, or pulper; in this case, the pulp is called refined mechanical pulp. Both these processes may be carried out either in atmospheric pressure or under pressurized conditions. In the latter case, one speaks of pressure ground pulp, and correspondingly thermo-mechanical pulp (TMP). The principle of both the processes is to separate the wood fibres mechanically and with the help of heat generated in connection with the treatment. The mechanical energy applied to the fibre material is changed into heat, softening the intermediate lamella (which is lignin), and thus promoting defibration. By pressurizing the processes, the softening of the intermediate lamella is promoted.

Both the grinding and defibration techniques force the fibre bundles separated from the fibre material to become subject to hydraulic forces. In addition, the fibres have to travel out of the pulper through a small discharge gap. The following drawbacks may be said to relate to the said known methods:

- power consumption is big, because the fibres are to a great extent separated by heat;
- small limited capacity;
- the flow through the pulper has to be promoted additionally by pressurized forced feed;
- a further drawback related with defibration solutions is that transverse blades promoting defibration and fibrillation essentially reduce production.

When fibres are used in special products such as concrete or gypsum based sheet products, the fibres needed are dispersed (in case of chemical pulp) e.g. from high-quality chemical pulp dried in ball mills in a sheet form, which is expensive. Sometimes also waste paper is used.

In the cleaning of waste paper fibres (de-inking process), the dispersion process is relatively ineffective when carried out in big tanks and using fast rotating blades. Dispersion and separation of printing ink pigment particles take place in the collision point of the blades, but this "finished product" circulates and burdens the whole process until all the fibres are separated from each other, and even the last pigment particles are detached from the fibres (which is hardly ever achieved). In this overlong process, the finished products have to undergo the same process over and over again, and quite unnecessarily, so that the fibres are further quite unnecessarily cut into pieces.

Thus, there has prevailed a need to develop a new and efficient method and device for defibrating fibre-containing material.

The object of the present invention is to provide a new and efficient method and device for defibrating fibre-containing material.

This object is achieved by a method and device in accordance with the invention, which are characterized by what is disclosed in the characterizing part of the appended claims.

Devices operating with the pin mill principle are previously known, for example, from the Danish patent publication DK 104778, and the Finnish patent applications FI 945945, FI 946048, and FI 955474. Characteristic of these devices is that two concentric rotors equipped with collision surfaces are fitted into a housing. The rotors are fitted within each other in the housing and arranged to rotate to opposite directions. According to another alternative, a rotor equipped with collision surfaces and a stator concentric with the rotor and equipped with collision surfaces are fitted into the housing.

A feed orifice opening to the centre of the rotors or the rotor and stator are arranged at the end of the housing, and a discharge orifice opening to the periphery of the outermost rotor or stator is arranged on the wall of the housing.

The fibre-containing material is led to the housing via the feed orifice and is made to flow in the housing together with a suspension produced by air or added liquid through the collision surfaces of the nested rotors or the nested rotor and stator to the discharge orifice and further as a discharge flow out of the housing.

Defibration may be carried out either without added water or by adding water. The used liquid is suitably either water or an aqueous solution.

The defibration process may be processed in many ways. The fibre-containing material (wood chips) may be pretreated by an aqueous solution which includes peroxide, sodium carbonate or sodium hydroxide. By using peroxide, it is possible to simultaneously bleach the product. Alternatively, the treatment with additives may be performed solely in the pin mill, or the said treatment methods may be combined.

For promoting the defibration, it is also possible to subject the fibre-containing material to a pretreatment with aqueous vapour of about 130° C., when desired, before the fibre-containing material is led to the pin mill. Alternatively, or in addition to this pretreatment, defibration in the pin mill may be carried out in pressurized conditions, advantageously in such an overpressure (about 1.7 bar) that a vapour saturation temperature of about 130° C. is achieved.

According to an embodiment of the invention, the established fibre suspension is in total or partly circulated back to the pin mill one time or several times.

The method according to the invention is very well suited for the defibration of different grasses. Defiberizing grasses with present methods is problematic, because the grass walls contain a large amount of silica minerals, generating indissoluble deposits in the process equipment. When processing grasses with a sulphate cellulose method, it is not possible to effectively recover black lye because of this problem. By treating this kind of grass material in a pin mill, the silica minerals are released, whereafter they can be separated from the fibre-containing material. The obtained fibre material may be used as such as mechanical pulp, or it may be processed further in the pulping process.

The method of the invention is very well adapted for use in the treatment of waste paper, in which the fibres are separated from printing ink pigments. In the re-use of waste paper (de-inking), the dispersion of fibres and the separation of ink pigment take place in a very short time as compared with the old methods, and each "unit" is subjected to an exactly identical treatment and made "first time right" without unnecessary inconvenient repetitions.

According to one embodiment, one or more mineral components may be fed into the pin mill together with the fibre-containing material.

For example, if the fibre-containing material consists of wood chips or mechanical, semi-chemical or chemical pulp suitable for the manufacture of paper, the mineral component may be a filler adapted for paper manufacture, e.g. titanium dioxide or the like. The problem with known processes with titanium dioxide is weak retention which again leads to operating troubles, environmental stress, and unprofitable production economy. By treating the fibre-containing material in the pin mill together with a mineral component, a good contact is provided between the fibre and the mineral particle so that the said problems are eliminated or considerably reduced. When the fibre-containing material is treated in the pin mill together with the mineral particles, also the fibrillation of fibres is achieved. Thus it is also possible to conduct the grinding of fibre-containing material in the pin mill.

According to another embodiment of the invention, the mineral component may be concrete, sand, or a combination of these. Applying the technique of the invention, concrete, gypsum or polymer based products may be manufactured directly from the material by simultaneously processing binding agents and the fibre-containing material, preferably wood chips or similar material, in the pin mill.

The technique of the invention may also be applied to the manufacture of so-called MDF boards in which fine fibre material is dispersed together with the binding agent in the pin mill.

In addition, the technique of the invention is also suited for the treatment of inorganic fibre material. In the manufacture of acoustic and other decorative boards, raw mineral wool may be dispersed with binding agents and possible other additives in a device according to the invention.

It is typical of all the above mentioned embodiments of the invention that the fibre-containing material is treated in the pin mill simultaneously with the possible additives.

The present invention is next described referring to the enclosed drawings, in which.

Figure 3:
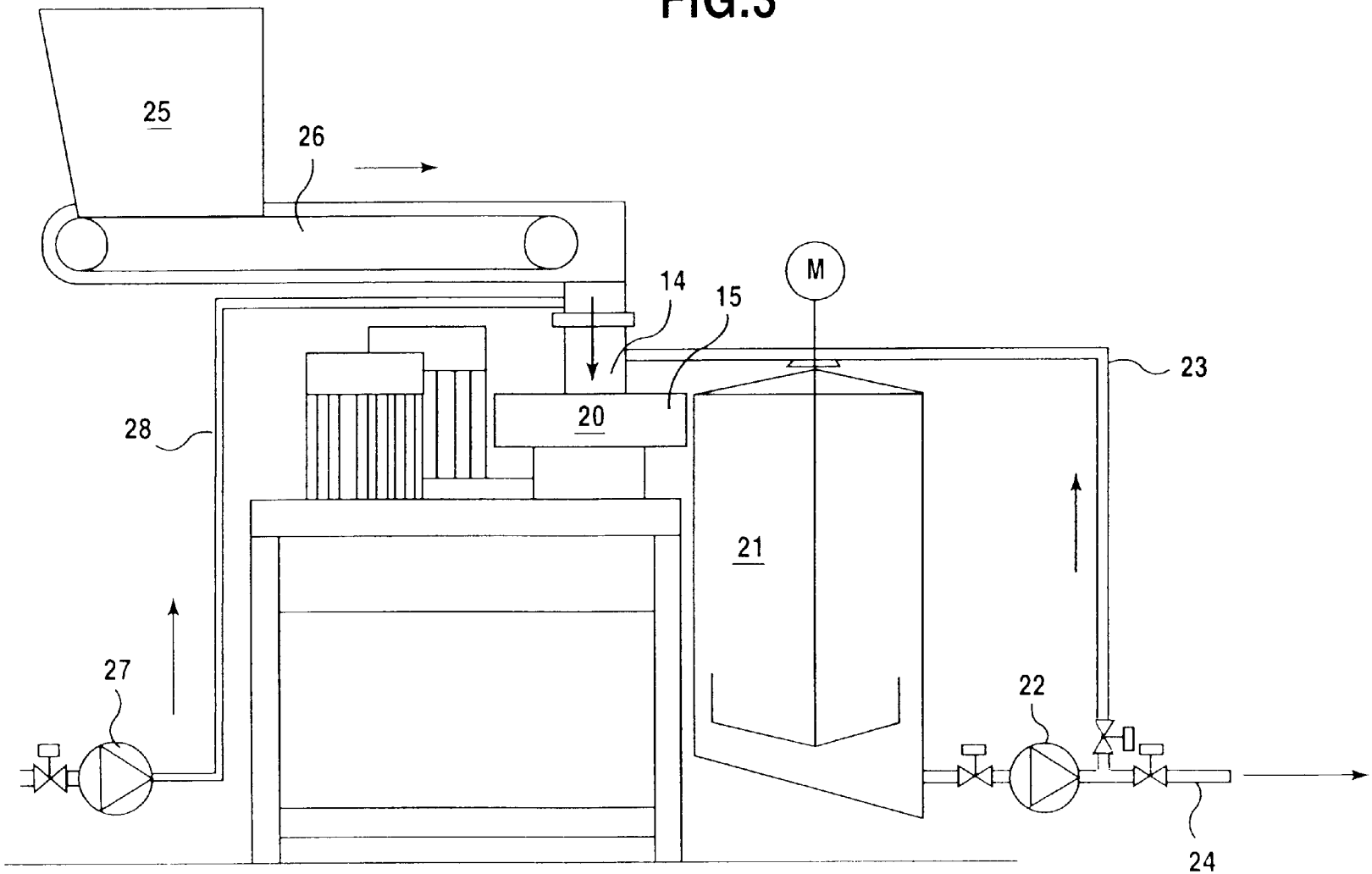
Figure 4:
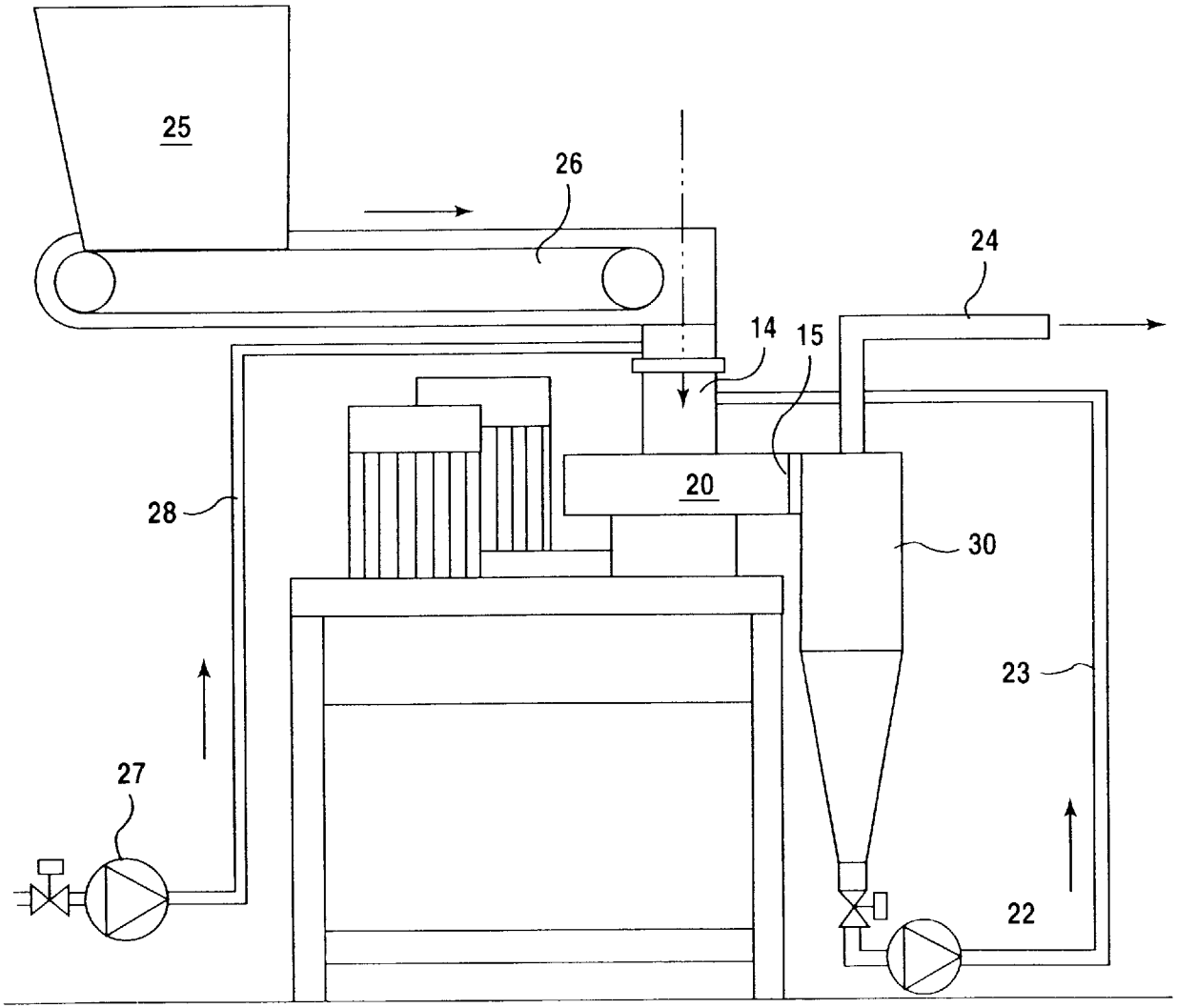
Figure 5:
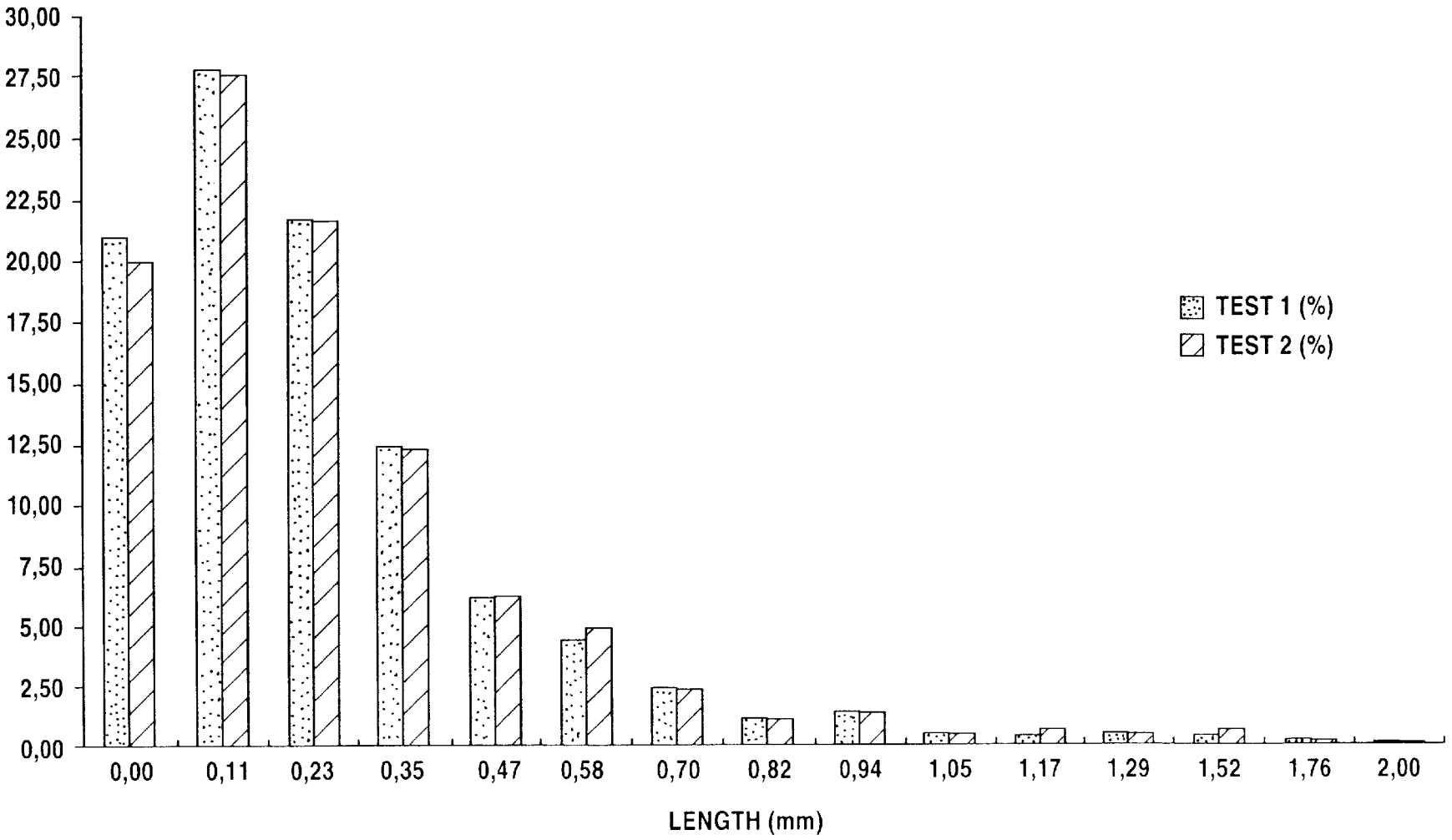

FIG. 3 presents equipment for defiberizing wood chips with the method according to the invention;

FIG. 4 presents another embodiment in which the device of the invention is used for defiberizing wood chips; and FIG. 5 presents the distribution of the fibre length of the mechanical pulp manufactured with the method of the invention.

Figure 1:
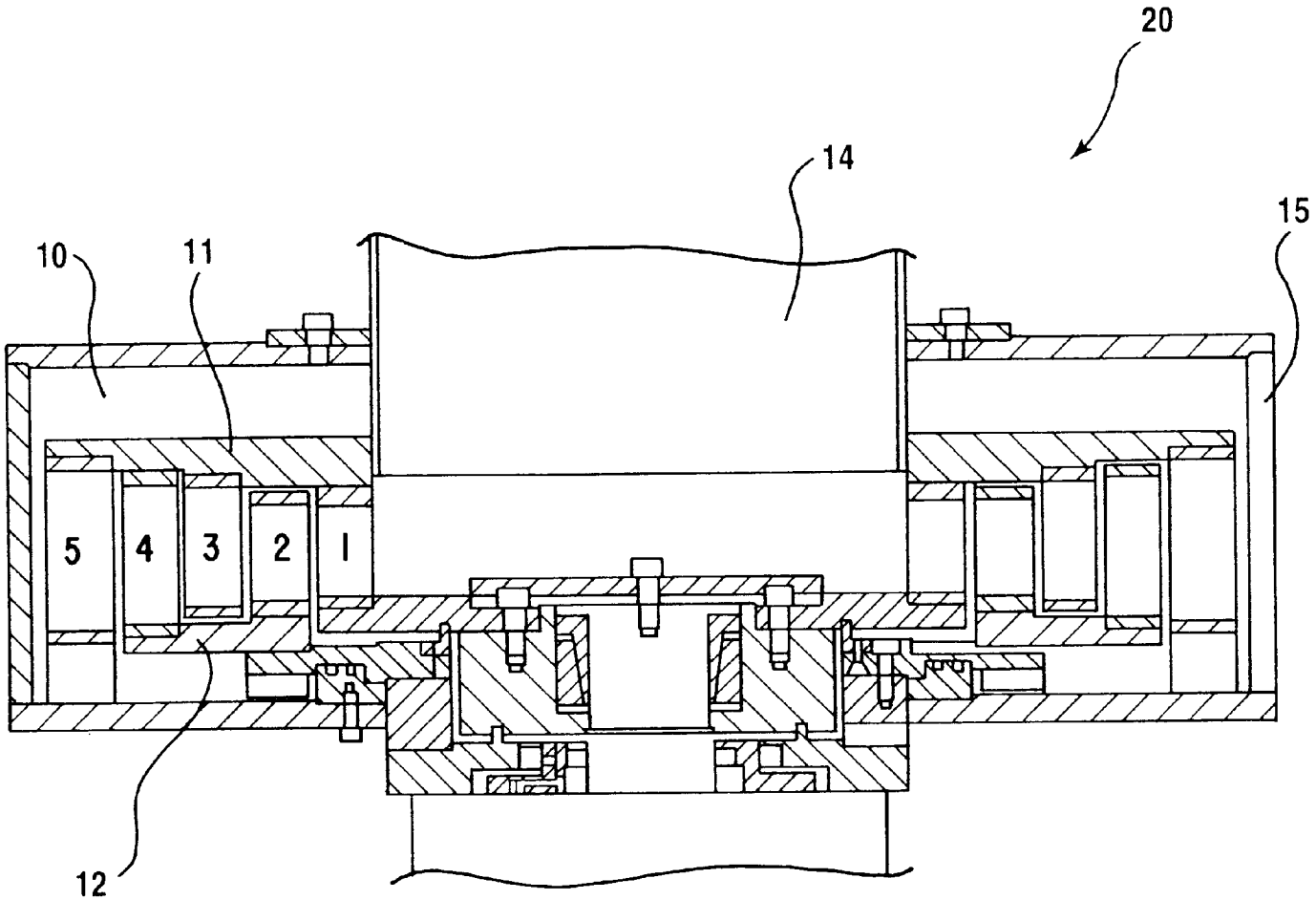
FIG. 1 is an elevation view of a multi-peripheral pin mill used in the method of the invention.

In FIG. 1, there is shown an elevation view of a pin mill 20 used in the method of the present invention. The pin mill 20 comprises a housing 10 with a rotor 11 equipped with collision surfaces 1*a*, 1*b* . . . 3*a*, 3*b* . . . , etc. fitted inside (the single collision surfaces are more precisely seen in FIG. 2). Also a second rotor 12 concentric with the first rotor 11 and also equipped with collision surfaces 2*a*, 2*b* . . . , 4*a*, 4*b* . . . , etc. is fitted into the housing. The collision surfaces 1*a*, 1*b* . . . 2*a*, 2*b* . . . 3*a*, 3*b* . . . , of the first rotor 11 and the second rotor 12 are arranged in concentric peripheries 1, 2, 3 . . . so that the peripheries 1, 3, 5 of the first rotor and the peripheries 2, 4 of the second rotor are interspersed. In this way the rotors 11 and 12 are capable of freely rotating to different directions.

An orifice 14 operating as a feed orifice for the fibre-containing material and opening to the centre of the rotors 11 and 12 is arranged at the head of the housing. An orifice 15 is operating as a discharge orifice and opening to the outer collision surface periphery is arranged on the housing wall.

The second rotor 12 may also be replaced by a stator equipped with collision surfaces, but the solution with two rotors is preferable. Rotors rotating to opposite directions generate powerful centrifugal forces, effectively keeping the flow-through moving, which the stator-rotor system is not capable of doing.

Figure 2:
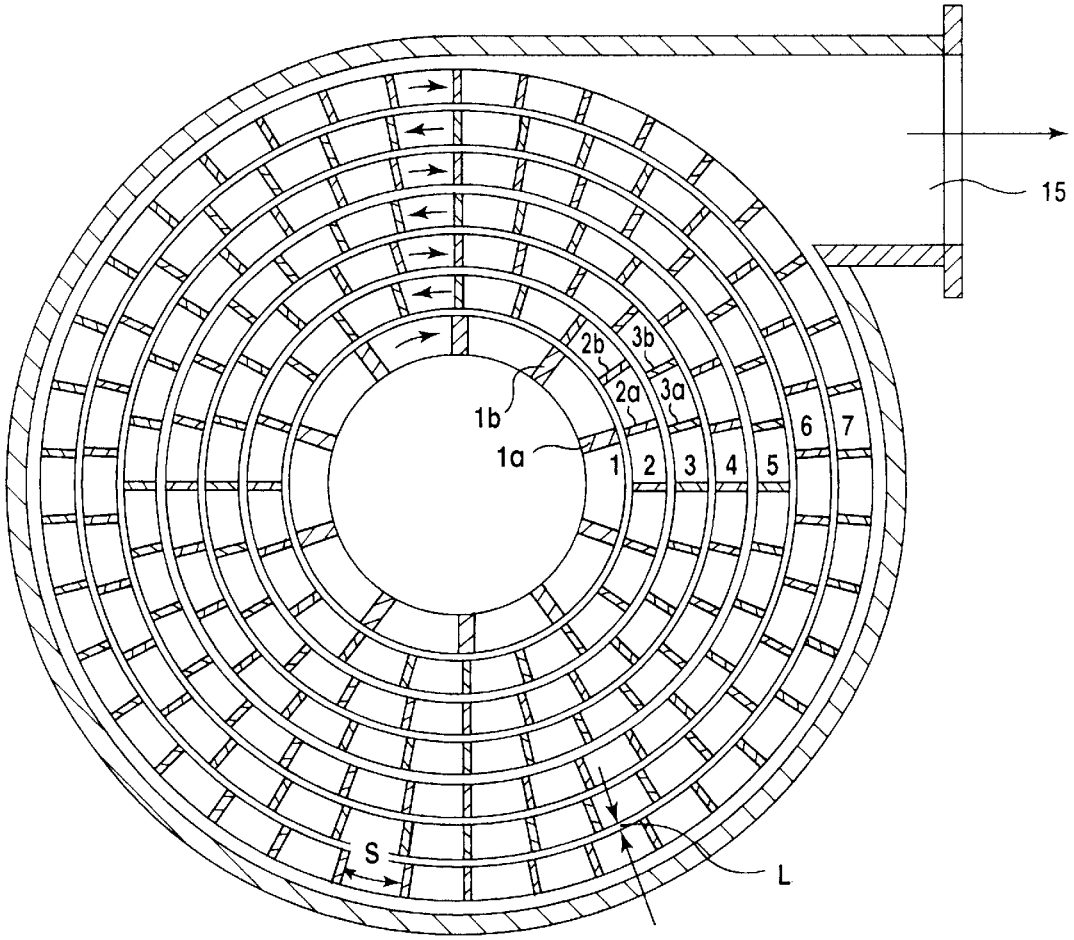
FIG. 2 is a horizontal sectional view of a device of the type shown in FIG. 1.

In FIG. 2, which presents a horizontal sectional view of a device of the type in FIG. 1 (indeed modified in a way that both the rotors 11, 12 have one periphery more than the device in FIG. 1), there are shown the rotation directions of the rotors. Naturally, both the rotors may also rotate to the opposite direction.

In accordance with the solution in FIG. 2, the horizontal distance L between the peripheries 1, 2, 3 . . . is about 3 mm and identical between all the peripheries. According to an advantageous embodiment, which is not shown in the figures, the device is constructed or adjusted so that the distance L between adjacent peripheries decreases towards the outermost periphery 7 of the device. The distance L between the outermost peripheries 6 and 7 is preferably about 0.2 mm.

According to an advantageous embodiment of the invention, the device is constructed so that the distance S between the collision surfaces of the outermost peripheries is smaller than the distance between the collision surfaces of the inner peripheries.

With the above mentioned measures it may be ensured that also coarser fibre-containing material (coarse wood chips) may be fed into the device, and nevertheless well enough defiberized pulp may be achieved. An essential advantage is that the number of collision surfaces for the rotor peripheries and the distances between the peripheries (tightness) are selected according to needs. The distance between peripheries, and likewise the distance between the collision surfaces in the peripheries may be arranged so that they decrease towards the outer periphery. In this way the dispersing pieces of wood chips are led to tighter and tighter places before the established suspension is discharged from the device.

The periphery wall of the pin mill housing does not need to be situated in close proximity of the rotor pair (cf. rotor/stator), but it may be placed farther away so that the housing may be rather large. The purpose of the housing is then to operate mainly as a receiver for the pulp suspension.

In FIG. 3, there is shown a pin mill 20 of the invention, including a feed orifice 14 and a discharge orifice 15. The discharge orifice 15 is connected to a mixing tank 21, from which the produced fibre suspension is, when desired, led back to the pin mill 20 by a circulating pump 22 and via a circulating pipe 23 through the feed orifice 14. The finished suspension is discharged through a discharge pipe 24. Wood chips are led with a belt feeder 26 from a chip funnel 25 to the pin mill 20 through the feed orifice 14. Additionally, liquid (water or an aqueous solution) may be led to the feed orifice 14 with a feed pump 27 from a liquid feed pipeline 28. Valves are indicated with the 10 reference number 29.

The equipment may operate so that the fibre-containing material is fed to the pin mill 20 with a belt feeder 26. A necessary amount of liquid (water or aqueous vapour) is simultaneously fed into the pin mill 20, preferable as hot. The dry material and liquid are ground and dispersed (defiberized) in the device, and they "fly" by the action of centrifugal force to a secondary mixing device or mixing tank 21 in which they become subject to continuous mixing in order to prevent solid matter from descending. From the mixing device, part of the produced fibre suspension, fibre pulp, may be pumped back into the pin mill, and part may be led forward to the next stage of the process.

If desired, the fibre suspension may also be circulated in total.

The rotors of the pin mill rotate with the speed of 1500–3000 $min^{-1}$, preferably about 2000 $min^{-1}$.

In FIG. 4, there is shown a second assembly in which the defiberized fibre material and liquid are led from the pin mill to a cyclone 30, from which fine matter is led forward in the process, and coarse matter is circulated back into the pin mill 20. There may be several pin mills connected in series, or they may be connected to a series or in succession with conventional grinding devices of other devices.

In addition, the method and device of the invention have the following advantages:

- when desired, wood chips may be fed into the device according to the invention in atmospheric pressure, and the feed is then carried out totally in a renewed pin mill/mixing device quite freely to a large feed orifice (while in other corresponding devices the feed has to be conducted under pressurized conditions through an axle);
- in the new treatment method, the pieces of wood chips are subjected to strong, immediately repeated collisions changing direction, regardless of their size;
- this treatment gives the fibre bundles cyclical pressure-underpressure shocks which are advantageously promoted by the fibres separating from each other at the same time as they remain spaced apart during the short time of treatment;
- the product flow need not necessarily pass through one single, narrow gap restricting the capacity, but the device may be very open so that drawbacks of the previous methods turn to advantages;
- with the new method, the separated fibres remain spaced apart until they are spun out of the device.

Test Results

Spruce chips were defibrated in a pin mill with the method of the invention, the gained pulp was analyzed, and test sheets were made of the accept part, of which strength properties were measured.

Raw materials, test device and test conditions

The wood chips were pine chips supplied by the Rauma paper mill and were, according to the supplier, of very poor quality. The dimensions of the chips were as follows: width 30 . . . 40 mm, length 30 . . . 40 mm, and thickness 6 . . . 10 mm.

About 20 kg of air-dry chips and about 250 l of water were used in the test, which was performed in a temperature of 40° C.

The chips were fed into a pin mill 20 according to FIG. 3 with a belt feeder 26, and water was added by a feed pump 27 (1500 l/h). The amount of chips fed was so big that the final consistency of the pulp was 7%. About 250 kg of pulp was recovered in the mixing tank 21 after the pin mill. The pulp collected into the tank 21 was in total circulated back into the pin mill through the circulating pipe 23 with a speed of 4500 kg/h (75 kg/min). The circulating was carried on for about 10 minutes so that the amount of circulated pulp was 750 kg. Thus the pulp passed through the pin mill three times.

The diameter of the lower rotor of the pin mill used in the test was 0.54 m, and that of the upper rotor 0.60 m. The rotation speed of both the rotors was 2000 $min^{-1}$ so that the peripheral speed of the lower rotor was 56 m/s and that of the upper rotor 63 m/s. Peripheral clearances were altogether 2 mm.

Energy Consumption

The electric energy needed by the rotors to crush the chips, or for the first run of the chips through the pin mill, was 0.9 kWh, i.e. 3.9 kWh for a ton of pulp suspension. As the pulp contained 20 kg of air-dry wood material, one can conclude that the energy consumption per ton of air-dry pulp was 45 kWh.

For circulating the obtained coarse pulp 6 kWh, or 8 kWh per pulp suspension, was consumed. The energy consumption for this stage is 114 kWh/t as calculated for a ton of air-dry pulp.

As is apparent from below, 40% of the circulated pulp were immediately usable (freeness number 130), and 60% were splinters. Thus, the energy consumption of the circulation stage as calculated per a ton of air-dry useable pulp was 285 kWh/t. If also the energy consumed at the first stage i.e. for the first-stage treatment of the chips (45 kWh/t) is added, the result is 330 kWh per a ton of acceptable air-dry pulp. Taking into consideration that the energy consumption for a conventional ground pulp process is about 1.4 MWh/t, and the corresponding number for a thermomechanical pulp or TMP process is as much as 2.5 MWh/t, it may be noted that with the above described method of the present invention a very considerable save in energy is achieved.

Mass and Paper Testing

The reject or splinter content of the gained pulp (Valmet) was 60.2%. This reject was removed, and the properties of the remaining pulp or accept were as follows:

| | |
|---|---|
| Freeness (CFS) | |
| 130 ml | |
| Pulp content (Kajaani FS-100) | 0.59 mm |
| Fibre classification (Bauer McNeff): | |
| residue on the wire 30 | 26.31% |
| intermediate fraction 30 . . . 50 | 20.21% |
| intermediate fraction 50 . . . 100 | 13.40% |
| intermediate fraction 100 . . . 200 | 8.34% |
| through the wire 200 | 31.74% |

It may be observed from the results of the fibre classification that the first fraction (residue on the wire 30) is clearly larger than the corresponding fraction of the mechanical pulp. The intermediate fractions 50 . . . 100 and 100 . . . 200 again are clearly smaller than the corresponding fractions of the mechanical pulp.

In FIG. 5, there is shown the distribution of fibre length as performed in accordance with two different tests.

Test sheets were manufactured from the accept pulp by using a standard method, and the results are as follows:

| | |
|---|---|
| Surface weight | 61.49 $g/m^2$ |
| Density | 255.6 $kg/m^2$ |
| Tear index | 3.74 $Nm^2/kg$ |
| Tensile index | 10.8 Nm/g |
| ISO lightness | 54.4% |
| Opacity | 95.96% |

In this test, the tensile index is clearly lower than with mechanical pulps. However, it has to be noted that this is only the first test, in which the running conditions are in no way finally optimized. An exceptionally low energy consumption and the promising pulp and paper test results give a clear picture about the development potential of the process.

It is obvious for those skilled in the art that various embodiments of the invention may vary within the scope of the appended claims.

What is claimed is:

1. A method for defibrating fiber-containing material comprising wood chips, grass, or mechanical, semi-chemical or chemical pulp for use in paper manufacturing, comprising i) providing a defibrating device having a) a rotatably-mounted first rotor equipped with collision surfaces mounted thereon in concentric peripheries;

b) a rotatably-mounted second rotor equipped with collision surfaces mounted thereon in concentric peripheries and adapted to rotate in a direction opposite to that of said first rotor, said second rotor in cooperating relationship with said first rotor such that the collision surfaces of said first rotor and the collision surfaces of said second rotor project toward each other and are interspersed, c) a housing containing said first and second rotors, and having a feed orifice and a discharge orifice, said feed orifice in communication with a center of said first and second rotors and being sufficiently large that fiber-containing material may be fed freely therethrough at ambient pressure; said discharge orifice in communication with a periphery of an outermost rotor;

ii) feeding said fiber-containing material into said feed orifice of said defibrating device, such that said fiber-containing material is made to flow with the aid of air or liquid to said first and second rotors, and then through said collision surfaces to said discharge orifice to produce defibrated material; and iii) collecting said defibrated material from said discharge orifice.

2. The method of claim 1, wherein said fiber-containing material is made to flow with the aid of a liquid selected from the group consisting of water or an aqueous solution.

3. The method of claim 1, further comprising adding an additive which promotes defibration to said fiber-containing material before or during feeding of said fiber-containing material to said feed orifice.

4. The method of claim 1, further comprising pretreating said fiber-containing material with an aqueous vapor at a temperature of about 130° C. before feeding it to said defibrating device; and/or maintaining said defibrating device at an elevated pressure such that a steam saturation temperature of about 130° C. is achieved during defibrating of said fiber-containing material.

5. The method of claim 1, wherein a mineral component is fed with said fiber-containing material to said defibrating device.

6. The method of claim 5, wherein said mineral component is a member selected from the group consisting of concrete, sand and a combination of concrete and sand.

7. The method of claim 5, wherein said fiber-containing material is wood chips, or a mechanical, semi-chemical or chemical pulp suitable for the manufacture of paper, and wherein said mineral is a filler.

8. The method of claim 7, wherein said mineral is titanium dioxide.

9. The method of claim 1, wherein said fiber-containing material is waste paper, and wherein fibers are separated from printing ink pigments.

10. The method of claim 1, wherein said fiber-containing material is grass, and wherein silicate released during said method is separated from pulp.

11. The method of claim 1, wherein said defibrated material is a suspension which is partly or totally recirculated back into said defibrating device at least once.

* * * * *